US005706622A

United States Patent [19]

Lange

[11] Patent Number: 5,706,622

[45] **Date of Patent: *Jan. 13, 1998**

[54] MODULAR STRUCTURAL FRAMING SYSTEM

[76] Inventor: Fredric Lange, 13690 Elm Creek Rd., Osseo, Minn. 55369-9343

[ * ] Notice: The term of this patent shall not extend beyond the expiration date of Pat. No. 5,588,274.

[21] Appl. No.: 257,719

[22] Filed: Jun. 10, 1994

[51] Int. Cl.[6] ..... E04C 3/08

[52] U.S. Cl. ..... 52/653.1; 52/584.1; 52/650.1; 52/726.1; 24/20 R; 24/270

[58] Field of Search ..... 52/650.1, 651.01, 52/586.1, 726.1, 726.5, 726.3, 653.1, 651.07, 584.1; 24/295, 455, 20 R, 270; 285/189, 420

[56] References Cited

U.S. PATENT DOCUMENTS

| | | | |
|---|---|---|---|
| 577,598 | 2/1897 | Fordyce | 52/659 |
| 921,196 | 5/1909 | Yuzuk | 439/646 |
| 2,485,644 | 10/1949 | Norquist | 52/272 |
| 2,625,769 | 1/1953 | Hubbard . | |
| 2,709,094 | 5/1955 | Polanski . | |
| 2,787,035 | 4/1957 | Konefes | 24/295 |
| 3,088,178 | 5/1963 | Propst | 52/586.1 |
| 3,247,637 | 4/1966 | Robertson . | |
| 3,399,916 | 9/1968 | Ensor | 52/588.1 |
| 3,414,152 | 12/1968 | Overton, III . | |
| 3,417,533 | 12/1968 | Sparling . | |
| 3,469,339 | 9/1969 | Thomas . | |
| 3,534,519 | 10/1970 | James | 52/581 |
| 3,552,055 | 1/1971 | Matsubayashi et al. . | |
| 3,681,870 | 8/1972 | Alpert . | |
| 3,970,346 | 7/1976 | Kreyschmer | 24/295 |
| 4,044,497 | 8/1977 | Bettens . | |
| 4,512,117 | 4/1985 | Lange . | |
| 4,573,754 | 3/1986 | Hill | 439/638 |
| 4,637,193 | 1/1987 | Lange . | |
| 4,775,258 | 10/1988 | Lange . | |
| 4,776,719 | 10/1988 | Kreider . | |
| 4,776,721 | 10/1988 | Lange . | |
| 4,787,768 | 11/1988 | Lange . | |
| 4,923,245 | 5/1990 | Kuwabara | 24/295 |
| 4,969,923 | 11/1990 | Reeder et al. | 285/420 |
| 4,978,244 | 12/1990 | Lange . | |
| 4,982,546 | 1/1991 | Lange . | |
| 5,150,927 | 9/1992 | Skinner et al. | 285/189 |

FOREIGN PATENT DOCUMENTS

| | | | |
|---|---|---|---|
| 213245 | 2/1958 | Australia | 52/690 |
| 0031863 | 7/1981 | European Pat. Off. . | |
| 0279987 | 8/1988 | European Pat. Off. . | |
| 567452 | 3/1924 | France | 52/659 |
| 2218706 | 10/1973 | Germany . | |
| 8805221 | 9/1988 | Germany . | |
| 8907034 | 8/1989 | WIPO . | |

*Primary Examiner*—Michael Safavi
*Attorney, Agent, or Firm*—Peterson, Wicks, Nemer & Kamrath, P.A.

[57] ABSTRACT

A framing system (10) including three-dimensional structural members (12, 14) formed from planar panels (16) having their edges removably secured together by provisions (48) including a slide connector (66) which receives lugs (52) slideably received in and abutting with latches (56). The panels (16) include interconnect ports (22) having integral, concentric tubes (24). The exterior faces (18) of the structural members (12, 14) are abutted together, with the structural members (12, 14) being clamped by a clamping band (28) having a central wall (30) abutting with the tubes (24) and first and second side walls (32, 34) abutting with the free faces (25) of the tubes (24). In the preferred form, the clamping band (28) is split and is removably locatable in the ports (22) by being distortable into a helical shape by flex notches (40, 42) formed in the side walls (32, 34). Relative rotation is prevented between the clamping band (28) and the structural members (12, 14) by detents (44) formed in the clamping band (28) which are received in notches (26) formed in the free face (25) of the tubes (24).

33 Claims, 1 Drawing Sheet

MODULAR STRUCTURAL FRAMING SYSTEM

BACKGROUND

The present invention generally relates to modular structural framing systems, and particularly to attachment panels, unitary clamping bands, and interconnect apparatus therefor.

The craft of building structures is well known. Typical wood framing utilizing 2 inch by 4 inch (5 cm by 10 cm) studs has been used for construction for many years, with metal studs being used more recently. Further, steel, aluminum, wood, plastic, and other materials have been used for fabricating tubing, channel, "T" or "I" beams, and like structural members. Typically, studs and other structural members are joined together with nails, barbed plates, bolts, rivets, and the like. Other structures utilized columns and beams connected by other methods of fastening including rope lashing, special notch cutting, mitering and nesting techniques, and the like to obtain strong and simple connections to build a variety of structures. As time progressed, building materials such as stone, wood, steel, and more recently composites have become standardized in size, weight, and strength. The introduction of truss or space frames allowed building materials to have reduced structural mass and increased span resulting in higher strength to weight ratios. However, most construction practice used in fastening building structural components of a structure together still rely upon common devices such as nails, rivets, bolts, and like fasteners. Also, building materials are generally of a solid mass or unitized truss member requiring the maximum space for storage or transport. Further, quick connect/disconnect fastening mechanisms for structural members so that they can be rapidly assembled and disassembled without compromising structural strength are known such as shown in U.S. Pat. No. 4,776,721. However, such fastening mechanisms utilized clamping mechanisms extending around the periphery of portions of the structural members thus restricting the configuration thereof and/or location of the attachment of one structural member to another, i.e. an in-line end tube connection will not attach to the side wall of another tube, etc., and often would not allow communication through the fastening mechanism. Also, prior quick connect/disconnect fastening mechanisms may only join together respective male/female structural members by a change in orientation and by radial translation and/or displacement of one or more members to interfit the male/female interface.

Thus, a need exists for modular structural framing systems including components which overcome the disadvantages of prior fastening mechanisms.

SUMMARY

The present invention solves these needs and other problems in the field of framing systems by providing, in the preferred form, an interconnect apparatus including a clamping member which is removably locatable in ports of abutting first and second structural members for abutting with the ports and the opposite faces of the first and second structural members and clamping the first and second structural members together.

In a preferred aspect of the present invention, the clamping member is in the form of a split band having a generally channel-shaped transverse cross section and includes circumferentially spaced flex notches in the side walls to allow the central wall to flex to form the band into a helix shape.

In other preferred aspects of the present invention, the structural members are formed from attachment panels secured together by their edges. In a preferred form, the interconnect port includes a tube integrally extending from the plate beyond the interior face to allow minimizing the thickness of the plate.

Also in a preferred form, the edges of the attachment panels are removably secured together by the receipt of beveled free edges of a plurality of spaced lugs extending from the edges of the panels in the beveled latching edges of a plurality of complementary spaced latches.

It is then an object of the present invention to provide a novel modular structural framing system.

It is further an object of the present invention to provide such a novel framing system providing an optimum of design flexibility with concurrent engineering analysis for safe, trouble-free building.

It is further an object of the present invention to provide such a novel framing system having a high strength-to-weight ratio for structural support.

It is further an object of the present invention to provide such a novel framing system which is quick and easy to assemble without the use of tools thereby reducing labor costs and with a connection strength for safety and durability.

It is further an object of the present invention to provide such a novel framing system reducing the time for structural component assembly as well as the construction of the resulting structures from the assembled components, which is especially important when time is a constraint in the assembly and construction of the structures being built.

It is further an object of the present invention to provide such a novel framing system having modular interlocking components interconnectable at multiple locations on all sides and at the ends.

It is further an object of the present invention to provide such a novel framing system requiring fewer components to save in unnecessary inventory build-up and cost.

It is further an object of the present invention to provide such a novel framing system allowing all sizes of beams, columns, intersections for different loads, spans, and working heights to be made from the same components and specifically does not require different size trusses or space frames for different loads and spans.

It is further an object of the present invention to provide such a novel framing system which can be stored and transported knocked-down.

It is further an object of the present invention to provide such a novel framing system utilizing structural members (and particularly cubes) formed from a common, locking panel which can be formed by a manufacturing process utilizing a single tool, die, or the like.

It is further an object of the present invention to provide such a novel framing system providing hollow structural members connected together with passage therebetween.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figures 1, 2, 3, 4, 5, 6:
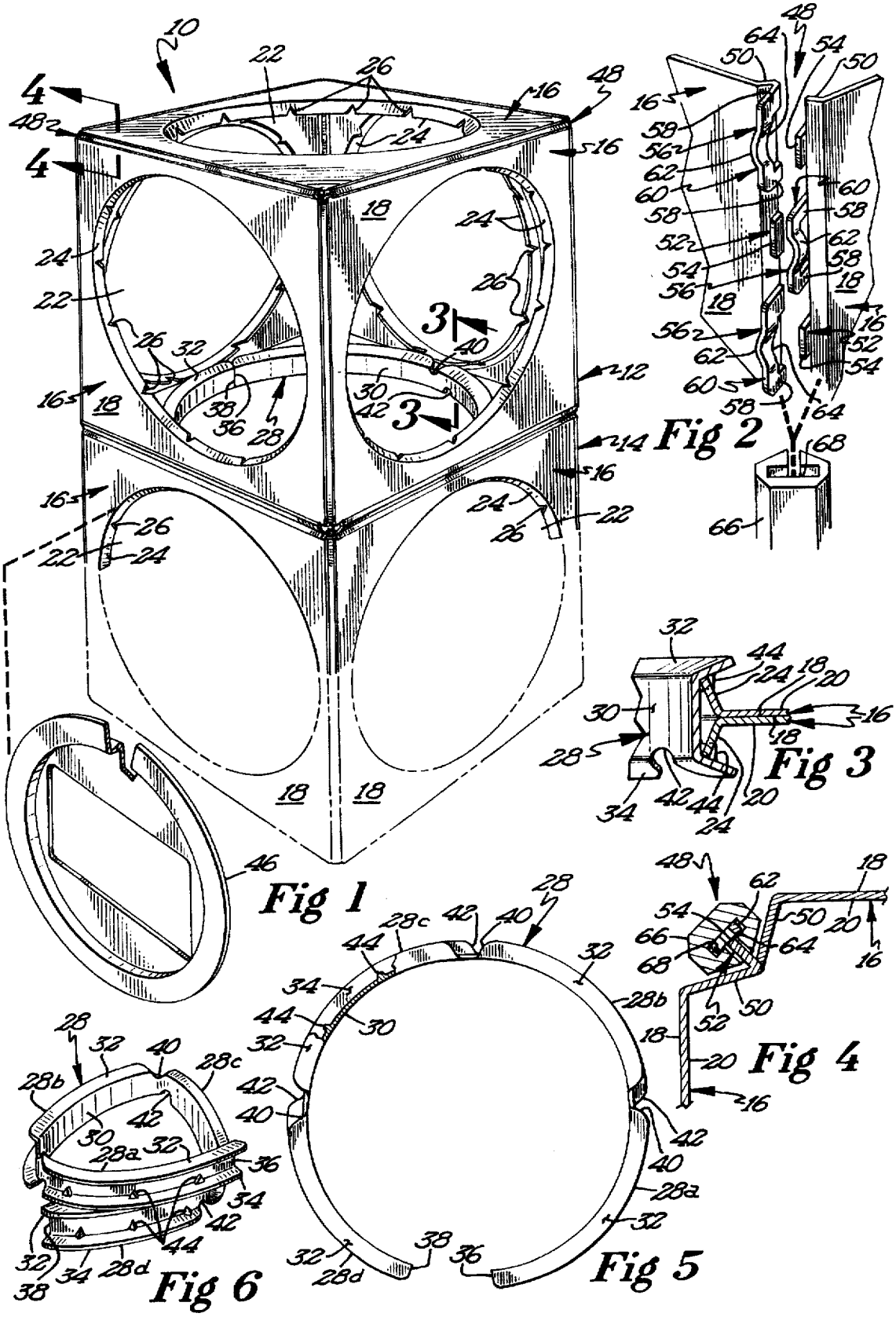
FIG. 1 shows an exploded, perspective view of a modular structural framing system according to the preferred teachings of the present invention, with portions being shown in phantom.
FIG. 2 shows a partial, exploded, perspective view of the modular structural framing system of FIG. 1.
FIG. 3 shows a cross-sectional view of the modular structural framing system of FIG. 1 according to section line 3—3 of FIG. 1.
FIG. 4 shows a cross-sectional view of the modular structural framing system of FIG. 1 according to section line 4—4 of FIG. 1.
FIG. 5 shows a top, plan view of the unitary clamping band of the modular structural framing system of FIG. 1 in its normal shape.
FIG. 6 shows a perspective view of the unitary clamping band of the modular structural framing system of FIG. 1 in its insertion shape.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "end", "interior", "exterior", "face", "edge", and similar terms are used herein, it should be understood that these terms have reference only to the structure shown in the drawings as it would appear to a person viewing the drawings and are utilized only to facilitate describing the invention.

DESCRIPTION

A modular structural framing system according to the preferred teachings of the present invention is shown in the drawings and generally designated 10. System 10 includes first and second, hollow, structural truss members 12 and 14 shown in a preferred form as hollow parallelepipeds, in the preferred form as right parallelepipeds, and in the most preferred form as cubes. Specifically, hollow structural members 12 and 14 include attachment panels 16 secured by their edges to form and define the hollow interior, with panels 16 being planar when members 12 and 14 are in the form of parallelepipeds and being generally of the same size and shape when members 12 and 14 are in the form of cubes. Panels 16 include first, exterior faces 18 and second, interior faces 20 defining a panel thickness. Interconnect ports 22 of the same shape and size are formed in each of panels 16 extending through faces 18 and 20, with ports 22 being symetrical in the preferred form and shown as being cylindrical in shape in the most preferred form. A tube 24 having a cross section corresponding to the shape of port 22 integrally extends from panel 16 beyond second, interior face 20, with tube 24 having a free end defining a third panel face 25 generally parallel to and spaced from faces 18 and 20. Notches 26 are formed in the free end of tube 24 and are circumferentially spaced from each other such as 30° apart. Tube 24 is generally cylindrical-shaped and in the most preferred form is frusto-conical in shape and extends at an obtuse angle relative to face 20, with the frusto-conical shape allowing nesting of panels 16 during storage and/or transport.

In the most preferred form of the present invention, system 10 further includes provisions 48 for removably securing the edges of planar panels 16 to form three-dimensional members 12 and 14. Specifically, the edges of panels 16 terminate in a connecting flange 50 extending at an acute angle in the order of 60° relative to face 20. A plurality of lugs 52 extend generally perpendicularly from and equally spaced along the free edge of flange 50 in an exterior direction. The free edges 54 of lugs 52 are beveled at an acute angle in the order of 60° and specifically along a plane which intersects with flange 50. A plurality of latches 56 extend generally perpendicularly from and equally spaced along the free edge of flange 50 in an exterior direction, with latches 56 being located intermediate lugs 52. Latches 56 are generally U-shaped including first and second legs 58 having their first ends connected to flange 50 and spaced a distance generally equal to and for slideable receipt of lugs 52. The second ends of legs 58 are connected to a head 60 extending between legs 58. Head 60 includes an angled portion 62 extending generally parallel to and spaced above flange 50. Head 60 further includes a lower edge 64 spaced from the free edge of flange 50 of panel 16 generally equal to the length of lugs 52 and beveled at an acute angle complementary to and for receipt of free edges 54 of lugs 52 and in the preferred form at an angle in the order of 60° and specifically along a plane which intersects with flange 50.

It should then be noted that lugs 52 of a first panel 16 are slideably received in latches 56 of a second panel 16 between legs 58, with edges 64 abutting and hooking with edges 54, and with lugs 52 of the second panel 16 being slideably received in latches 56 of the first panel 16. Thus, it can be appreciated that panels 16 are disengagably divergent generally in a plane in the order of 45° from of opposing panels 16 and yet are locked when engaged with forces imposed at 90° to engaged panels 16. In the hooked relation, lugs 52 and latches 56 have a generally T-shaped end view, with lugs 52, legs 58 and the portions of heads 60 aside from angled portions 62 lying within the same plane and defining the leg of the T-shaped end view and angled portions 62 lying in a plane which intersects the plane of lugs 52 and legs 58 at a nonlinear angle and defining the head of the T-shaped end view. Provisions 48 further include a connector 66 for holding lugs 52 in latches 56. In the preferred form, connector 66 is a slide connector and slideably receives lugs 52 and latches 56. Specifically, connector 66 in the preferred form includes a T-shaped slot 68 of a size for slideable receipt upon the T-shaped end view of lugs 52 and latches 56 in their hooked relation.

It can then be appreciated that panels 16 can be of a standardized design and in the case of a cube, can be of identical construction, with panels 16 having different orientations to arrange lugs 52 and latches 56 in their latching relation to form members 12 and 14. Further, it can be appreciated that panels 16 including lugs 52 and latches 56 can be stacked with faces 18 and 20 in an abutting relation to save space during storage and/or transport (with the nesting of tubes 24 in the most preferred form). It should further be noted that the angular relation of flanges 50 allows provisions 48 to be flush with faces 18 of panels 16 assembled into members 12 and 14. Also, slot 68 can be manufactured with sufficient tolerances to allow a covering to extend over faces 18 and over lugs 52 and latches 56 and be sandwiched between slot 68 and lugs 52 and latches 56, with the covering being utilized for any desired function such as a screen, or the like.

System 10 in the most preferred form of the present invention further includes a unitary clamping band 28 for clamping first and second structural members 12 and 14 together. Generally, band 28 includes a central wall 30 and outwardly directed first and second side walls 32 and 34 extending from the first and second edges of wall 30. Walls 30, 32 and 34 have a generally channel-shaped or U-shaped transverse cross section. Wall 30 has a width between side walls 32 and 34 which is generally equal to twice the width between first and third faces 18 and 25 of panel 16. Walls 32 and 34 extend from wall 30 at an angle corresponding to the angle of tube 24 with face 20, and in the preferred form is at an obtuse angle. Band 28 is generally annular shaped and in the preferred form includes provisions allowing its removable location in ports 22 of panels 16. Specifically, in the preferred form, band 28 is split and includes a transverse cut defining first and second free ends 36 and 38 in walls 30, 32, and 34. First, circumferentially spaced, flex notches 40 are formed in wall 32. Second, circumferentially spaced, flex notches 42 are formed in wall 34, with the circumferential spacing between notches 40 and between notches 42 being complementary to each other and in the preferred form being equal. However, notches 42 are circumferentially offset from notches 40 to allow wall 30 to flex to allow walls 30, 32, and 34 to be distorted into a helix shape. Specifically, the portions of wall 30 extending between notches 40 and 42 which are angled from the longitudinal axis due to the circumferential offset of notches 40 and 42 act as hinges to allow band 28 to be distorted from a normal shape which is generally annular but U-shaped and of a size larger than ports 22 to an insertion shape in the form of a helix and of a size smaller than and for insertion into ports 22. Particularly, in the preferred form shown, three sets of notches 40 and 42 are provided in side walls 32 and 34 to divide band 28 into 4 integrally connected portions 28*a*, 28*b*, 28*c*, and 28*d*, with free ends 36 and 38 located on portions 28*a* and 2*d*, respectively. In a preferred form, end 36 can be pushed radially inwardly (with portions 28*a* and 28*b* pivoting about the portions of wall 30 between the first two sets of notches 40 and 42) of end 38. At that time, band 28 can be circumferentially distorted to abut side wall 34 of portion 28*a* with side wall 32 of portion 28*d*. Then, ends 36 and 38 can be moved in opposite circumferential directions and simultaneously radially inward (with portions 28*a*, 28*b*, 28*c*, and 28*d* pivoting relative to each other about the portions of wall 30 between notches 40 and 42) to be in a spaced relation and forming band 28 into the helix shape. It can then be appreciated that portions 28*a*, 28*b*, 28*c*, and 28*d* generally retain the same shape while band 28 is being distorted. Due to the resiliency of the portions of wall 30 extending between notches 40 and 42, band 28 is biased from the insertion shape to its normal shape. Circumferentially spaced detents 44 are formed in band 28 of a size, shape, number, and position for receipt in notches 26 of tube 24, with detents 44 formed by stamping side walls 32 and 34 in the most preferred form, with it being possible to form panels 16 and bands 28 by other processes including but not limited to die casting, vacuum forming and the like.

Further according to the preferred teachings of the present invention, bands 28 can be distorted outwardly beyond its normal shape with the portions of wall 30 extending between notches 40 and 42 acting as hinges to allow bands 28 to be stacked and nested together for storage and/or transport when the free edges of walls 32 and 34 have a concentric shape to wall 30 as in the most preferred form.

Now that the basic construction of system 10 according to the preferred teachings of the present invention has been explained, the operation and further subtle features of system 10 can be set forth and appreciated. Specifically, in the preferred form, structural members 12 and 14 are placed adjacent to each other, with faces 18 of panels 16 of complementary shapes (planar in the most preferred form) abutting and with ports 22 in an aligned position. It should be appreciated that members 12 and 14 can have any rotational relation relative to each other, with notches 26 of members 12 being axially aligned with notches 26 of member 14 in the most preferred form. At that time, band 28 can be distorted to its helical insertion shape to pass through port 22 of member 12 to the interior of member 12 and then located in ports 22 of the abutting panels 16 of members 12 and 14. At that time, band 28 can be released and will attempt to return to its normal shape. With side walls 32 and 34 located on opposite sides of faces 25 of the abutting panels 16, band 28 will conform to an annular, clamping shape of a size corresponding to ports 22 of the abutting panels 16 and specifically with wall 30 being generally circular and abutting with tubes 24, with free ends 36 and 38 abutting, and with side walls 32 and 34 abutting with faces 25 and sandwiching tubes 24 of the abutting panels 16 together. It should then be noted that the angular relation of walls 32 and 34 to wall 30 acts as a camming surface for faces 25 to draw members 12 and 14 together. Further, the complementary angular relation of tubes 24 to face 20 and of walls 32 and 34 to wall 30 causes tubes 24 to abut walls 32 and 34 at a perpendicular angle for increased force transfer.

It should further be noted that when wall 30 extends across and abuts with tubes 24, detents 44 of band 28 are received in notches 26 to prevent panels 16 of members 12 and 14 from rotating relative to band 28 and thus relative to each other. It can be appreciated that to change the rotational position of member 12 and 14 relative to each other, band 28 can be distorted from its annular shape towards its helical, insertion shape sufficiently to remove detents 44 from notches 26 (but with portions of walls 32 and 34 being within the axial extent of tubes 24) and allow rotation of member 12 and/or 14 relative to band 28 until the desired notches 26 are circumferentially aligned with detents 44, with band 28 then being released to expand to its clamping shape and receive detents 44 in notches 26.

It should then be noted that if a compression force is placed on members 12 and 14, faces 18 of the abutting panels 16 abut. If a tension force is placed between members 12 and 14, faces 25 of the abutting panels 16 abut with side walls 32 and 34 in a generally perpendicular manner to prevent separation of panels 16. If a shear force is placed between members 12 and 14, wall 30 abuts with tubes 24 to prevent relative movement between members 12 and 14. It should then be appreciated that under shear forces between members 12 and 14, band 28 is placed under compression forces with free ends 36 and 38 abutting to prevent undesired collapse or distortion of band 28. In the most preferred form due to notches 40 and 42, the abutting forces between ends 36 and 38 tend to cause band 28 to distort with side walls 32 and 34 abutting with face 25 adjacent to ends 36 and 38. This distortion tends to prevent ends 36 and 38 from sliding past each other resulting in collapse of band 28 but rather insures that ends 36 and 38 abut keeping band 28 in an annular condition. If desired, ends 36 and 38 can include enlarged abutment surfaces or other provisions for preventing ends 36 and 38 from sliding past each other. If a force is placed on members 12 and 14 which would tend to produce relative rotation therebetween, detents 44 of band 28 abut with notches 26 of panels 16 of members 12 and 14 to prevent such relative rotation. It should then be noted that forces placed on members 12 and 14 will typically be a combination of compression, tension, shear, and rotation forces.

To allow separation of members 12 and 14, band 28 can be distorted to its insertion shape and specifically to allow its removal from ports 22 of the abutting panels 16 and passage to the hollow interior of member 12 or 14 and through an exterior port 22 thereof. With removal of band 28, the abutting panels 16 of members 12 and 14 are not clamped together and can be separated or otherwise moved relative to each other.

According to the preferred teachings of the present invention, in addition to being of complementary shapes for abutting with each other, the interconnect or abutting faces 18 of members 12 and 14 are of an identical, contiguous abutting configuration, and specifically system 10 according to the preferred teachings of the present invention does not require the interconnect faces to be of an interfacing male/female variety. Thus, system 10 allows members 12 and 14 to have unlimited and unrestricted interconnect options and orientations at the ends or along the sides of members 12 and 14 or any structure formed therefrom. Further, system 10 does not require radial translation or displacement of members 12 and 14 relative to each other for connection or disconnection thereof. Additionally, in the most preferred form, members 12 and 14 of system 10 can be clamped together or be unclamped without the use of tools. Further, ports 22 of the adjacent panels 16 are self-aligning with the positioning of band 28 therein. Thus, members 12 and 14 can be easily and rapidly clamped together or separated with minimal skill required.

Further, it should be appreciated that open passage or communication is allowed through band 28 to the hollow interiors of the connected structural members 12 and 14 in the assembled condition of system 10 according to the teachings of the present invention. Thus, electrical, gas, or other fluid lines can be located and pass within the interior of system 10 in its assembled condition. Additionally, clamping of members 12 and 14 is accomplished within and located in ports 22 of the abutting panels 16 and specifically members located exteriorly of ports 22 are not required. For example, a panel 16 having a square configuration could be interconnected to a panel 16 having the same configuration or a different configuration including but not limited to rectangular, circular, or triangular and can be held at any desired angular orientation relative thereto by notches 26 and detents 44.

To close structural members 12 and 14 according to the preferred teachings of the present invention, suitable covers 46 can be snap fit or otherwise secured in the exterior ports 22 of members 12 and 14 and/or in band 28 in its clamping shape. In a preferred form, covers can include mounting provisions such as for electrical outlets or switches, as shown, or for other accessories such as lamps, knock-out provisions for passage of wiring, motor shafts, and the like, or other provisions for hanging, supporting, or otherwise attaching accessories and the like according to the preferred use of system 10 according to the preferred teachings of the present invention. Although in the preferred form ports 22 are formed in all surfaces of members 12 and 14 and is believed to be advantageous in maximizing the number of interconnect locations and options, members 12 and 14 could include panels 16 without the presence of ports 22 to enclose the interior of members 12 and 14 if desired.

Structural members 12 and 14 according to the preferred teachings of the present invention can have a variety of forms and shapes. Particularly, members 12 could be a wall having port 22. Likewise, members 12 and 14 could have elongated shapes of a fixed or variable length and including multiple ports 22 along its elongated length such that interconnection can be made at any one or any combination of ports 22. Likewise, members 12 and/or 14 could be wedge-shaped or arch-shaped of either a fixed or variable angle to allow interconnection of members 12 and 14 into an arch-like structure or could be in the form of corner stiffeners. Likewise, members 12 and/or 14 could be in the shape of a node for a space frame. Likewise, although panels 16 are shown as being planar, panels 16 can have other configurations which have a complementary, abutting relation.

It should further be appreciated that system 10 according to the teachings of the present invention can be universally applied to make all size beams, columns, intersections, etc. for different loads, spans, and working heights with the same modular components. Specifically, members 12 and 14 can be connected end-to-end for the desired length and/or can be connected side-to-side for the desired cross-sectional size. Likewise, members 12 and 14 can be interconnected at multiple locations on all sides and ends to form the desired frame or structural element. As system 10 according to the teachings of the present invention does not require different size trusses or space frames designed or engineered for different loads and/or spans but rather allows modular construction according to the particular application, fewer component parts are required, saving in unnecessary inventory build-up and cost for the manufacturer, retailer, and user of system 10. Further, the modular construction and multiple interlocking locations provided by system 10 according to the teachings of the present invention allow the relatively few components to provide more freedom and design versatility to meet the most demanding architectural applications or designs.

It should also be appreciated that system 10 according to the preferred teachings of the present invention has a high strength-to-weight ratio for structural support. In this regard, it should be noted that the bends forming tubes 24 and flanges 50 in the most preferred form provide enhanced structural strength and stability to panel 16 to allow the thickness between faces 18 and 20 to be minimized, with such minimization being advantageous in reducing the material and thus the cost of manufacture and in reducing the storage/transport size of panels 16 in their knocked-down, nested, stacked condition. Similarly, although assembly of system 10 can be quickly and easily performed without the use of tools, the connection strength provided by band 28 between members 12 and 14 is to a factor of four for safety and durability according to the teachings of the present invention.

System 10 according to the preferred teachings of the present invention has a multiple of applications and uses. For example, system 10 could be utilized as a modular, changeable structure such as a habitat for gerbils, hamsters, or similar rodents. Similarly, system 10 could be utilized as truss structures for structures which are desired to be frequently torn down and set up such as trade show booths. It should be noted that system 10 is particularly advantageous as wiring, lights, and other electrical equipment can be located within the hollow interior of structural members 12 and 14 and of bands 28. Likewise, ports 22 can be utilized as attachment ports for banners, shelves, and the like. Further, system 10 is particularly advantageous due to its small (dense pack) containerization during deployment of large space structural members 12 and 14 and due to its ability to assemble and disassemble without the use of tools in a minimum amount of time, especially for use in outer space or underwater constructions. Additionally, system 10 could act as an external truss for a pipe or similar structure passing through bands 28 and the hollow interior of members 12 and 14. It should then be appreciated that if such a pipe were sized to fit tightly within bands 28, such pipe would increase the structural strength of system 10 or system 10 would also otherwise increase the load carrying capability across a pipe or reduce its deflection across the span according to the preferred teachings of the present invention.

Now that the basic teachings of system 10 according to the preferred teachings of the present invention have been set forth, other variations will be obvious to persons skilled in the art. For example, although ports 22 are shown in the most preferred form as being cylindrical, ports 22 can have other shapes such as having octagonal or other multisided cross sections.

Although in the preferred form, notches 26 are formed in panels 16 and detents 44 are formed in bands 28 and are believed to be advantageous for at least manufacturing reasons, it can be appreciated that the rotation preventing provisions can take other forms including being at reversed locations.

Likewise, although in the most preferred form, band 28 is removably located in ports 22 of structural members 12 and 14 due to its provisions for distorting to an insertion shape which in the preferred form is allowed by the transverse cut creating free ends 36 and 38 and in the most preferred form is helical in shape, other provisions for removably locating band 28 in ports 22 can be provided. For example, structural members 12 and 14 could be separable to allow insertion of bands 28 in an enlarged port 22 which is then reduced with the uniting of structural members 12 and 14 to capture bands 28 therein.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Interconnect apparatus comprising, in combination: first and second structural members having first and second faces, with the first faces of the first and second structural members having complementary shapes abutting with each other; at least first ports formed in each of the first and second structural members, with the first ports extending through the first and second faces of the first and second structural members and being of the same size; means located in the first ports of the first and second structural members and abutting with the first ports and the second faces of the first and second structural members for clamping the first and second structural members together while allowing communication through the first ports of the first and second structural members, with the clamping means including means for removably locating the clamping means in the first ports of the first and second structural members, with the first and second structural members being rotatable relative to each other to multiple rotational positions; and means for preventing rotation of the first and second structural members relative to each other at one of the rotational positions of the first and second structural members.

2. The interconnect apparatus of claim 1 wherein the first ports have a generally cylindrical shape.

3. The interconnect apparatus of claim 2 wherein the rotation preventing means comprises circumferentially spaced notches formed in one of the clamping means and the first and second structural members; and detents formed in the other of the clamping means and the first and second structural members for slideable receipt in the notches.

4. The interconnect apparatus of claim 3 wherein the clamping means comprises a unitary member having a generally channel-shaped transverse cross section with first and second outwardly directed side walls extending from a central wall, with the central wall having a shape and size corresponding to the first ports.

5. The interconnect apparatus of claim 4 wherein the clamping means includes the removably locating means.

6. The interconnect apparatus of claim 5 wherein the removably locating means comprises, in combination: means for distorting the clamping means from a first clamping shape of a size corresponding to the first ports to a second insertion shape of a size smaller than and for insertion into the first ports, with the clamping means being biased from the second insertion shape to the first clamping shape.

7. The interconnect apparatus of claim 6 wherein the distorting means comprises a transverse cut in the clamping means to define first and second free ends, wherein the first and second free ends are in a generally abutting relation in the first clamping shape and are in a spaced relation in the second insertion shape.

8. The interconnect apparatus of claim 7 wherein the insertion shape is a helix.

9. The interconnect apparatus of claim 8 wherein the first and second side walls of the clamping means includes circumferentially spaced flex notches, with the flex notches of the first side wall being circumferentially offset from the flex notches of the second side wall.

10. The interconnect apparatus of claim 1 wherein the clamping means includes the removably locating means.

11. The interconnect apparatus of claim 10 wherein at least the first structural member is three-dimensional and is formed by an attachment panel, with the attachment panel comprising, in combination: a plate having the first face and an interior face defining a thickness, with the plate being planar, with the first interconnect port formed in the plate and extending through the first and interior faces, with the port having a shape; and a tube having a cross section corresponding to the shape of the port and integrally extending from the plate beyond the second face and concentric to the port, with the tube providing structural stability to the plate to allow minimizing the thickness of the plate and having a free end defining the second face generally parallel to and spaced from the first and interior faces.

12. The interconnect apparatus of claim 10 wherein at least the first structural member is three-dimensional and hollow, with the first structural member being formed by a plurality of attachment panels having first edges and means for removably securing the first edge of one attachment panel to the first edge of another attachment panel, with the removably securing means comprising, in combination: a plurality of lugs extending from and equally spaced along the first edge in a first direction, with each of the lugs having beveled free edges extending in the first direction; and a plurality of latches extending from and equally spaced along the first edge in the first direction intermediate the plurality of lugs, with each of the latches having a latching edge extending in the first direction and beveled at an angle complementary to and receiving the beveled free edges of the lugs of the other attachment panel in a hooked relation.

13. The interconnect apparatus of claim 1 wherein the clamping means comprises a unitary member having a generally channel-shaped transverse cross section with first and second outwardly directed side walls extending from a central wall, with the central wall having a shape and size corresponding to the first ports.

14. The interconnect apparatus of claim 1 wherein the removably locating means comprises, in combination: means for distorting the clamping means from a first clamping shape of a size corresponding to the first ports to a second insertion shape of a size smaller than and for insertion into the first ports, with the clamping means being biased from the second insertion shape to the first clamping shape.

15. The interconnect apparatus of claim 1 wherein the complementary abutting shapes of the first and second structural members are of an identical, contiguous abutting configuration.

16. Unitary clamping band including a central wall having first and second edges; first and second outwardly directed side walls extending from the first and second edges of the central wall respectively, with the walls having a generally channel-shaped transverse cross section; first, circumferentially spaced flex notches formed in the first side wall; and second, circumferentially spaced flex notches formed in the second side wall, characterized in that the first and second flex notches are circumferentially spaced complementary to each other but being circumferentially offset to allow the central wall to flex to form the walls into a helix shape.

17. The unitary clamping band of claim 16 further comprising, in combination: circumferentially spaced positioning detents formed in the central wall, with the detents being circumferentially spaced and offset from the first and second flex notches.

18. Attachment panel comprising, in combination: a plate including at least a first edge; and means for removably securing the first edge to an edge of another attachment panel to form a three-dimensional member; with the removably securing means comprising, in combination: a plurality of lugs extending from and equally spaced along the first edge in a first direction, with each of the lugs having a free edge extending in the first direction; and a plurality of latches extending from and equally spaced along the first edge in the first direction intermediate the plurality of lugs, with each of the latches having a latching edge extending in the first direction and at an angle complementary to and receiving the free edges of the lugs of the other attachment panel in a hooked relation.

19. The attachment panel of claim 18 wherein each of the latches comprises, in combination: at least a first leg having a first end connected to the first edge and a second end connected to a head, with the head including the latching edge spaced from the first edge.

20. The attachment panel of claim 19 wherein the first legs of the latches and the lugs lie within the same plane; and wherein the head includes an angled portion extending in a plane which intersects at a nonlinear angle to the plane of the first legs and the lugs.

21. The attachment panel of claim 20 wherein the plate is planar; and wherein the removably securing means further comprises, in combination: a slide connector having a slot slideably receiving the lugs and the legs, the heads, and the angled portions of the latches.

22. The attachment panel of claim 19 further comprising, in combination: a connecting flange extending at an acute angle relative to an interior face of the plate and having a free edge, with the first edge being the free edge of the connecting flange, with the lugs and the first legs lying within the same plane and extending generally perpendicularly from the first edge.

23. Interconnect apparatus comprising, in combination: first and second structural members having first and second faces, with the first faces of the first and second structural members having complementary shapes abutting with each other; at least first ports formed in each of the first and second structural members, with the first ports extending through the first and second faces of the first and second structural members and being of the same size; means located in the first ports of the first and second structural members and abutting with the first ports and the second faces of the first and second structural members for clamping the first and second structural members together while allowing communication through the first ports of the first and second structural members; and means for removably locating the clamping means in the first ports of the first and second structural members, with at least the first structural member being three-dimensional and formed by an attachment panel, with the attachment panel comprising, in combination: a plate having the first face and an interior face defining a thickness, with the plate being planar, with the first interconnect port formed in the plate and extending through the first and interior faces, with the port having a shape; and a tube having a cross section corresponding to the shape of the port and integrally extending from the plate beyond the interior face and concentric to the port, with the tube providing structural stability to the plate to allow minimizing the thickness of the plate and having a free end defining the second face generally parallel to and spaced from the first and interior faces.

24. The interconnect apparatus of claim 23 wherein the attachment panel further comprises, in combination: circumferentially spaced notches formed in the free end of the tube.

25. The interconnect apparatus of claim 24 wherein the tube is frusto-shaped and extends at an obtuse angle to the second face, with the frusto-shape allowing nesting of the attachment panel.

26. The interconnect apparatus of claim 24 wherein the clamping means includes the removably locating means.

27. The interconnect apparatus of claim 26 further comprising, in combination: circumferentially spaced positioning detents formed in the clamping means for slideable receipt in the notches of the attachment panel for preventing rotation of the first and second structural members relative to each other.

28. Modular structural framing system (10) comprising, in combination: first and second attachment panels (16) each having a plate including at least a first edge; means (48) for removably securing the first edge of the first attachment panel to the first edge of the second attachment panel (16) to form a first three-dimensional, structural member (12), with the removably securing means (48) comprising, in combination: a plurality of lugs (52) extending from and equally spaced along the first edge, with each of the lugs (52) having a free edge (54), and a plurality of latches (56) extending from and equally spaced along the first edge intermediate the plurality of lugs (52), with each of the latches (56) having a latching edge (64) at an angle complementary to and for receipt of the free edges (54) of the lugs (52) of the other attachment panel (16) in a hooked relation; a second structural member (14), with the first and second structural members (12, 14) having first and second faces (18, 25), with the first faces (18) of the first and second structural members (12, 14) having complementary shapes for abutting with each other; at least first ports (22) formed in each of the first and second structural members (12, 14), with the first ports (22) extending through the first and second faces (18, 25) of the first and second structural members (12, 14) and being of the same size; a unitary clamping band (28) including a central wall (30) having first and second edges, first and second outwardly directed side walls (32, 34) extending from the first and second edges of the central wall (30) respectively, with the walls (30, 32, 34) having a generally channel-shaped transverse cross section, first, circumferentially spaced flex notches (40) formed in the first side wall (32), and second, circumferentially spaced flex notches (42) formed in the second side wall (34), with the first and second flex notches (40, 42) being circumferentially spaced complementary to each other but being circumferentially offset to allow the central wall (30) to flex to form the walls (30, 32, 34) into a helix shape, with the clamping band (28) located in the first ports (22) of the first and second structural members (12, 14) for abutting with the first ports (22) and the second faces (25) of the first and second structural members (12, 14) for clamping the first and second structural members (12, 14) together while allowing communication through the first ports (22) of the first and second structural members (12, 14), with the first and second structural members (12, 14) having changeable rotational positions relative to each other; and means (26, 44) for preventing rotation of the first and second structural members (12, 14) relative to each other at one of the rotational positions of the first and second structural members.

29. Attachment panel comprising, in combination: a plate having a first face and a second face defining a thickness, with the plate being planar, at least a first interconnect port formed in the plate and extending through the first and second faces, with the first port having a shape, and a tube having a cross section corresponding to the shape of the first port and extending beyond the second face and concentric to the first port characterized in that the tube is integral and extends from the plate allowing the first face of the plate including the integral tube to be separated from or abutted with the first face of the plate of another attachment panel, with the tube providing structural stability to the plate to allow minimizing the thickness of the plate; wherein the tube has a free end defining a third face generally parallel to and spaced from the first and second faces and located on the opposite side of the second face than the first face; wherein the attachment panel further comprises, in combination: circumferentially spaced notches formed in the free end of the tube; and wherein the tube is frusto-shaped and extends at an obtuse angle to the second face, with the frusto-shape allowing nesting of the attachment panel.

30. The attachment panel of claim 29 wherein the tube extends exclusively beyond the second face; and wherein the first face of the plate is planar and has a contiguous abutting configuration.

31. The attachment panel of claim 29 wherein the tube is frusto-conical shaped.

32. Attachment panel comprising, in combination: a plate having a first face and a second face defining a thickness, with the plate being planar, at least a first interconnect port formed in the plate and extending through the first and second faces, with the first port having a shape, and a tube having a cross section corresponding to the shape of the first port and extending beyond the second face and concentric to the first port characterized in that the tube is integral and extends from the plate allowing the first face of the plate including the integral tube to be separated from or abutted with the first face of the plate of another attachment panel, with the tube providing structural stability to the plate to allow minimizing the thickness of the plate; wherein the plate includes at least a first edge; and wherein the attachment panel further comprises, in combination: means for removably securing the first edge to an edge of another attachment panel to form a three-dimensional member; with the removably securing means comprising, in combination: a plurality of lugs extending from and equally spaced along the first edge in a first direction, with each of the lugs having a free edge extending in the first direction; and a plurality of latches extending from and equally spaced along the first edge in the first direction intermediate the plurality of lugs, with each of the latches having a latching edge extending in the first direction and at an angle complementary to and for receipt of the free edges of the lugs of the other attachment panel in a hooked relation.

33. The attachment panel of claim 32 wherein the tube extends exclusively beyond the second face; and wherein the first face of the plate is planar and has a contiguous abutting configuration.

* * * * *